United States Patent [19]

Cabanos et al.

[11] Patent Number: 4,850,570

[45] Date of Patent: Jul. 25, 1989

[54] UNITIZED PORTABLE HOIST

[75] Inventors: Phil A. Cabanos, Santa Clara; Rafael T. Gonzaga, Fremont; Gordon E. Rado, Palo Alto, all of Calif.

[73] Assignee: United States of America, Washington, D.C.

[21] Appl. No.: 163,439

[22] Filed: Mar. 3, 1988

[51] Int. Cl.[4] ..... B66D 1/36

[52] U.S. Cl. ..... 254/337; 254/361; 254/379

[58] Field of Search ..... 254/337, 336, 335, 334, 254/339, 340, 361, 362, 379

[56] References Cited

U.S. PATENT DOCUMENTS

| | | | |
|---|---|---|---|
| 2,695,086 | 11/1954 | Parker | 254/337 X |
| 2,809,804 | 10/1957 | Sheard | 254/335 X |
| 3,467,359 | 9/1969 | Durand | 254/340 |
| 3,836,122 | 9/1974 | Pierce, Jr. | 254/340 X |
| 4,042,213 | 8/1977 | Schreyer | 254/337 X |
| 4,109,799 | 8/1978 | Munn | 254/361 X |
| 4,169,580 | 10/1979 | Hatlapa | 254/362 |

*Primary Examiner*—Daniel P. Stodola
*Assistant Examiner*—Katherine Matecki
*Attorney, Agent, or Firm*—Robert M. Wohlfarth; John P. Tarlano

[57] ABSTRACT

A unitized portable hoist having a base structure. A support structure is attached to the base structure. A hoist drum is rotatable attached to hydraulic motors which are in turn attached to the base structure. A crown block is attached to the base structure below the hoist drum. An electric motor drives a hydraulic pump, both of which are attached to the base structure. The hydraulic pump drives the hydraulic motors. A cable is taken up and let out by the hoist drum. A fall block rides on the cable.

1 Claim, 1 Drawing Sheet

UNITIZED PORTABLE HOIST

BACKGROUND OF THE INVENTION

The present invention related to a unitized portable hoist. The hoist has a cylindrical base that holds hoisting components.

The prior art shows various arrangements of hoisting components. These arrangements are not attached to a common portable base.

SUMMARY OF THE INVENTION

The present invention relates to a unitized portable hoist. The hoist has a cylindrical base structure. A support structure is provided on the upper outside portion of the base structure for holding the hoist above or to the side of load. A crane is attachable to the support structure for this purpose. The base structure contains an electric motor and a hydraulic pump. The electric motor activates the hydraulic motors located on the top of the base. The hydraulic motors activate a hoist drum. The hoist drum is also located on the top of the cylindrical base. The cylindrical base encloses a crown block and fall block.

A hoist cable is reeled in or out by the hoist drum. The hoist cable passes over the crown block and fall block. The hoist cable is reeled in or out by the hoist drum to move the fall block inward or outward of the base. A load is attachable to the fall block. The unitized hoist will move a load in either a horizontal or vertical direction.

DESCRIPTION OF THE PREFERRED EMBODIMENT

Figure 1:
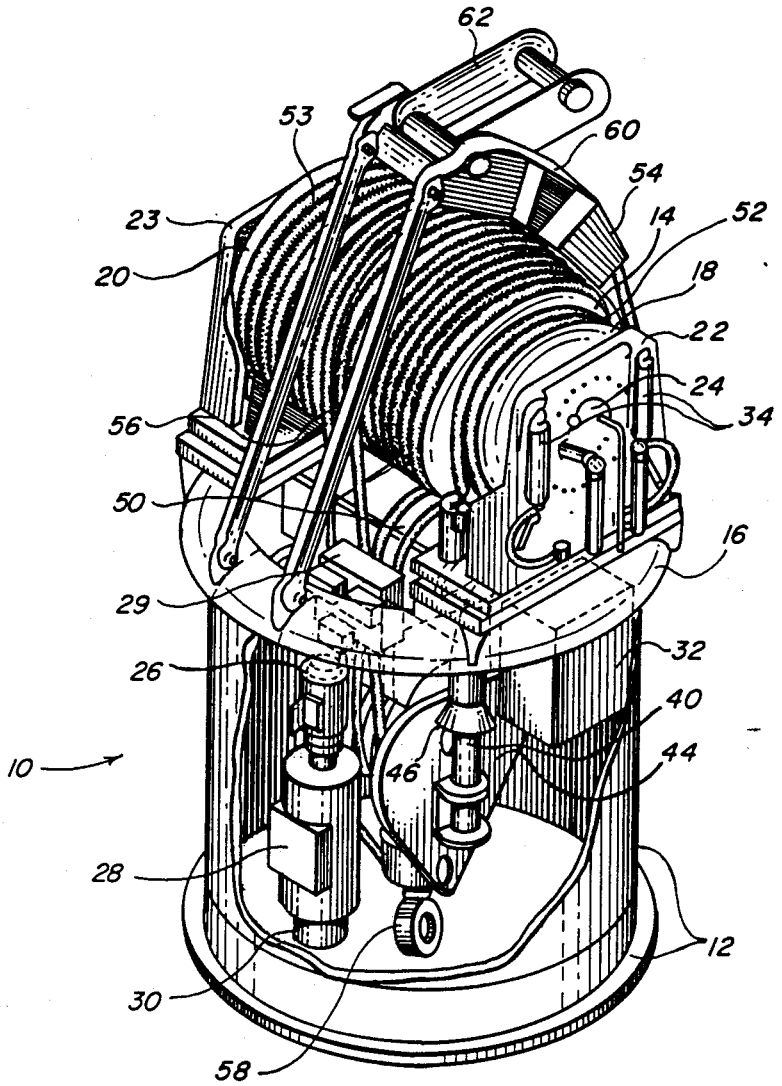
FIG. 1 is a perspective view of the self-contained hoist of the present invention.

The preferred embodiment of the present invention is illustrated by way of example in FIG. 1. FIG. 1 shows a unitized portable hoist 10. The hoist 10 has a cylindrical base 12. A hoist drum 14 is connected to a lip 16 of the base 12. The hoist drum 14 is driven by hydraulic motors 18 and 20. They are connected between the hoist drum 14 and frame elements 22 and 23, respectively. The two hydraulic motors 18 and 20 are attached directly to the hoist drum 14. They support and turn the hoist drum 14. They are of a radial piston type. They develop a very high torque at low RPM's. They contain support bearings, not shown, for the hoist drum 14. The hoist drum rotates on a shaft 24 connected to the frame elements 22 and 23. The hydraulic motors 18 and 20 are activated by pressurized hydraulic fluid. The pressurized fluid is supplied by a pump 26. The pump 26 is of a variable displacement piston type and is driven by electric motor 28. The displacement of the pump 26, and thus the speed of the hydraulic motors 18 and 20, is controlled by a pump displacement controller device 29.

The electric motor 28 also supplies power to a second pump 30. The second pump 30 is of a piston type. It has a fixed flow rate and a fixed output pressure. The second pump 30 uses reserve hydraulic fluid in hydraulic reservoir 32 to replace hydraulic fluid lost from the main hydraulic power loop. The second pump 30 also uses hydraulic fluid in the hydraulic reservoir 32 to drive drum brake release devices, one at 34 and another not shown. The pump 30 also drives extend/retract cylinders (not shown). The cylinders push a rod 40 attached on the front side of fall block 44, and another rod attached on the other side of fall block 44 (not shown), out of a tube 46 and another tube, attached on the corresponding sides of crown block 50.

Drum brake bands 52 and 53 act on the outer circular surfaces of the hydraulic motors 18 and 20. They prevent the hoist drum 14 from being turned by the force of gravity placed on a load, when the hydraulic motors 18 and 20 are not being driven. The brake bands 52 and 53 are released by the drum brake release devices 34 and 36.

A vent tank 54 is connected to the hydraulic reservoir 32 via a vent line. The vent tank 54 is a low pressure vessel. It is equipped with a vacuum/pressure relief valve. The vent tank 54 allows the hydraulic fluid in the reservoir 32 to remain near atmospheric pressure, without the fluid spilling out of the system.

A hoist cable 56 is taken up or let out, that is reeled in or reeled out, by hoist drum 14. One of the ends of hoist cable 56 is attached to hoist drum 14. The other end of the cable is attached to the base 12. The cable 56 passes around crown block 50. The crown block 50 is made up of a set of sheaves, a support shaft and a support structure. The crown block 50 reduces the tension in the hoist cable 56, by supporting a portion of the load that is being lifted. The crown block is connected to the inner surface of base 12. The hoist cable 56 also passes around fall block 44. The fall block 44 goes in or out of the base 12 as the cable 56 is taken up or let out by hoist drum 14. The fall block 44 translates the tension on the hoist cable 56 into a moving force on a load that is connected to eye 58 connected to fall block 44.

A support structure 60 is built around the hoist drum 14 and is attached to the lip 16 of the base 12. The support has a link 62. The link 62 may be moved into position that places the cylindrical base 12 either in a perpendicular orientation or a parallel orientation with respect to the surface of the earth. By means of the link 62, the hoist 10 may be moved by a crane either vertically or horizontally, or in between.

While the present invention has been disclosed in connection with the preferred embodiment thereof, it should be understood that there may be other embodiments which fall within the spirit and scope of the invention as defined by the following claims.

What is claimed is:

1. The unitized hoist for a load, comprising:

(a) a cylindrical portable base having a first circular end, a second circular end, an interior surface and an outer surface;

(b) a support structure attached to the outer surface of the cylindrical base;

(c) an electric motor mounted within the cylindrical base;

(d) a hydraulic pump connected to the electric motor, mounted within the cylindrical base;

(e) two hydraulic motors connected to the hydraulic pump, riding on one end of the cylindrical base;

(f) a hoist drum connected between the hydraulic motors;

(g) a hoist cable having one end reelably connected to the hoist drum, and another end connected to the base, riding on the hoist drum;

(h) a crown block for guiding the hoist cable and sharing the load with the drum, the crown block being attached to the interior of the cylindrical base at a point below the hoist drum; and (i) a fall block riding on the hoist cable, the fall block having means for connecting to a load.

* * * * *